US008429961B2

(12) United States Patent
Irani et al.

(10) Patent No.: US 8,429,961 B2
(45) Date of Patent: Apr. 30, 2013

(54) WIRELINE CONVEYED SINGLE PHASE FLUID SAMPLING APPARATUS AND METHOD FOR USE OF SAME

(75) Inventors: Cyrus A. Irani, Houston, TX (US); Scott L. Miller, Highland Village, TX (US); Paul David Ringgenberg, Frisco, TX (US); Luis Rubio Faria, Recreio dos Bandeirants (BR); Josana Silva Andrade, Granja dos Cavaleiros (BR); Pedro Varela, San Marcos (BR)

(73) Assignee: Halliburton Energy Services, Inc., Houston, TX (US)

( * ) Notice: Subject to any disclaimer, the term of this patent is extended or adjusted under 35 U.S.C. 154(b) by 345 days.

(21) Appl. No.: 13/008,764

(22) Filed: Jan. 18, 2011

(65) Prior Publication Data

US 2011/0174068 A1 Jul. 21, 2011

Related U.S. Application Data

(63) Continuation-in-part of application No. 11/951,946, filed on Dec. 6, 2007, now Pat. No. 7,874,206, which is a continuation-in-part of application No. 11/702, 810, filed on Feb. 6, 2007, now Pat. No. 7,472,589, which is a continuation-in-part of application No. 11/438,764, filed on May 23, 2006, now Pat. No. 7, 596,995, which is a continuation-in-part of application No. 11/268,311, filed on Nov. 7, 2005, now Pat. No. 7, 197,923.

(51) Int. Cl.
*E21B 49/00* (2006.01)

(52) U.S. Cl.
USPC ..... 73/152.23

(58) Field of Classification Search ..... None
See application file for complete search history.

(56) References Cited

U.S. PATENT DOCUMENTS

| | | | |
|---|---|---|---|
| 3,611,799 | A | 10/1971 | Davis |
| 4,570,481 | A | 2/1986 | McLaurin |

(Continued)

FOREIGN PATENT DOCUMENTS

| | | |
|---|---|---|
| EP | 0534732 | 9/1993 |
| GB | 2348222 | 9/2000 |
| WO | 0163093 | 8/2001 |
| WO | 2004099564 | 11/2004 |

OTHER PUBLICATIONS

Competitor Product Update, Schlumberger DST Sampling Systems—SCAR; (Undated but Admitted Prior Art).

(Continued)

*Primary Examiner* — Robert R Raevis
(74) *Attorney, Agent, or Firm* — Lawrence R. Youst

(57) ABSTRACT

An apparatus (10) for obtaining fluid samples in a subterranean well (14). The apparatus (10) includes a wireline conveyance (22) and a fluid sampler (12) supported by and positioned with the wireline conveyance (22) in the well (14). The fluid sampler (12) includes an actuator (24) operable to establish a fluid communication path between an exterior and an interior of the fluid sampler (12), a plurality of sampling chambers (26) operable to receive fluid samples therein and a self-contained pressure source (28) in fluid communication with the sampling chambers (26) operable to pressurize the fluid samples obtained in the sampling chambers (26) to a pressure above saturation pressure, thereby preventing phase change degradation for the fluid samples during retrieval of the fluid sampler (12) to the surface.

37 Claims, 5 Drawing Sheets

U.S. PATENT DOCUMENTS 4,665,983 A 5/1987 Ringgenberg
4,747,304 A 5/1988 King
4,787,447 A 11/1988 Christensen
4,878,538 A 11/1989 Christensen
4,883,123 A 11/1989 Zunkel et al.
4,903,765 A 2/1990 Zunkel
4,928,541 A * 5/1990 Toon et al. ..... 73/864.63
5,009,100 A 4/1991 Gruber et al.
5,058,674 A 10/1991 Schultz et al.
5,230,244 A 7/1993 Gilbert
5,240,072 A 8/1993 Schultz et al.
5,329,811 A 7/1994 Schultz et al.
5,368,100 A 11/1994 Lewandowski et al.
5,540,280 A 7/1996 Schultz et al.
5,687,791 A 11/1997 Beck et al.
5,934,374 A 8/1999 Hrametz et al.
6,065,355 A 5/2000 Schultz
6,073,698 A 6/2000 Schultz et al.
6,182,753 B1 2/2001 Schultz
6,182,757 B1 2/2001 Schultz
6,189,392 B1 2/2001 Schultz
6,192,984 B1 2/2001 Schultz
6,301,959 B1 10/2001 Hrametz et al.
6,439,307 B1 8/2002 Reinhardt
6,491,104 B1 12/2002 Wilie et al.
6,622,554 B2 9/2003 Manke et al.
6,668,924 B2 12/2003 Bolze et al.
6,722,194 B2 4/2004 Malard et al.
6,748,843 B1 6/2004 Barker et al.
6,907,797 B2 6/2005 DiFoggio
7,083,009 B2 8/2006 Paluch et al.
7,090,012 B2 8/2006 Hill et al.
7,128,144 B2 10/2006 Fox et al.
7,140,436 B2 11/2006 Grant et al.
7,195,063 B2 * 3/2007 Nogueira et al. ..... 166/264
7,197,923 B1 4/2007 Wright et al.
7,243,536 B2 * 7/2007 Bolze et al. ..... 73/152.24
7,246,664 B2 7/2007 Shammai et al.
7,258,167 B2 8/2007 Shammai et al.
7,367,394 B2 * 5/2008 Villareal et al. ..... 166/264
7,380,599 B2 6/2008 Fields et al.
7,395,712 B2 7/2008 Irani et al.
7,428,925 B2 9/2008 Brown et al.
7,430,965 B2 10/2008 Walker
7,472,589 B2 1/2009 Irani et al.
7,596,995 B2 10/2009 Irani et al.
7,621,325 B2 11/2009 Shammai et al.
7,673,506 B2 3/2010 Irani et al.
7,762,130 B2 7/2010 Irani et al.
7,874,206 B2 1/2011 Irani et al.
7,946,166 B2 5/2011 Irani et al.
7,967,067 B2 6/2011 Irani et al.
2004/0003657 A1 1/2004 Manke et al.
2005/0183610 A1 8/2005 Barton et al.
2005/0205301 A1 9/2005 Irani et al.

OTHER PUBLICATIONS

Schlumberger, "PVT Express, Accurate, mobile fluid analysis service"; (Oct. 2005).
Schlumberger, "MDT Single-phase sampling"; (2006).
OTC 18201, "Advances in Fluid Sampling with Formation Testers for Offshore Exploration"; (2006).
Schlumberger MDT drawing, "Single Phase Multisample Chamber"; (Undated but Admitted Prior Art).
EP International Search Report dated Aug. 29, 2007, International Application No. 07252099.2-1266; (Aug. 29, 2007).

* cited by examiner

WIRELINE CONVEYED SINGLE PHASE FLUID SAMPLING APPARATUS AND METHOD FOR USE OF SAME

CROSS-REFERENCE TO RELATED APPLICATIONS

This is a continuation-in-part of application Ser. No. 11/951,946, filed Dec. 6, 2007, which is a continuation-in-part of application Ser. No. 11/702,810, filed Feb. 6, 2007 now U.S. Pat. No. 7,472,589 issued Jan. 6, 2009, which is a continuation-in-part of application Ser. No. 11/438,764, filed May 23, 2006 now U.S. Pat. No. 7,596,995 issued Oct. 6, 2009, which is a continuation-in-part of application Ser. No. 11/268,311, filed Nov. 7, 2005, now U.S. Pat. No. 7,197,923 issued Apr. 3, 2007.

TECHNICAL FIELD OF THE INVENTION

This invention relates, in general, to testing and evaluation of subterranean formation fluids and, in particular, to a wireline conveyed single phase fluid sampling apparatus for obtaining multiple fluid samples and maintaining the fluid samples above saturation pressure using a self-contained pressure source during retrieval from the wellbore.

BACKGROUND OF THE INVENTION

Without limiting the scope of the present invention, its background is described with reference to testing hydrocarbon formations, as an example.

It is well known in the subterranean well drilling and completion art to perform tests on formations intersected by a wellbore. Such tests are typically performed in order to determine geological or other physical properties of the formation and fluids contained therein. For example, parameters such as permeability, porosity, fluid resistivity, temperature, pressure and saturation pressure may be determined. These and other characteristics of the formation and fluid contained therein may be determined by performing tests on the formation before the well is completed.

One type of testing procedure that is commonly performed is to obtain a fluid sample from the formation to, among other things, determine the composition of the formation fluids. In this procedure, it is important to obtain a sample of the formation fluid that is representative of the fluids as they exist in the formation. In a typical sampling procedure, a sample of the formation fluids may be obtained by lowering a sampling tool having a sampling chamber into the wellbore on a conveyance such as a wireline, slick line, coiled tubing, jointed tubing or the like. When the sampling tool reaches the desired depth, one or more ports are opened to allow collection of the formation fluids. The ports may be actuated in variety of ways such as by electrical, hydraulic or mechanical methods. Once the ports are opened, formation fluids travel through the ports and a sample of the formation fluids is collected within the sampling chamber of the sampling tool. After the sample has been collected, the sampling tool may be withdrawn from the wellbore so that the formation fluid sample may be analyzed.

It has been found, however, that as the fluid sample is retrieved to the surface, the temperature of the fluid sample decreases causing shrinkage of the fluid sample and a reduction in the pressure of the fluid sample. These changes can cause the fluid sample to reach or drop below saturation pressure creating the possibility of asphaltene deposition and flashing of entrained gasses present in the fluid sample. Once such a process occurs, the resulting fluid sample is no longer representative of the fluids present in the formation. Therefore, a need has arisen for an apparatus and method for obtaining a fluid sample from a formation without degradation of the sample during retrieval of the sampling tool from the wellbore. A need has also arisen for such an apparatus and method that are capable of maintaining the integrity of the fluid sample during storage on the surface.

SUMMARY OF THE INVENTION

The present invention disclosed herein provides a single phase fluid sampling apparatus and a method for obtaining fluid samples from a formation without the occurrence of phase change degradation of the fluid samples during the collection of the fluid samples or retrieval of the sampling apparatus from the wellbore. In addition, the sampling apparatus and method of the present invention are capable of maintaining the integrity of the fluid samples during storage on the surface.

In one aspect, the present invention is directed to a method for obtaining a fluid sample in a subterranean well. The method includes running a fluid sampler on a wireline conveyance to a target location in the well, establishing a fluid communication path between an exterior of the fluid sampler and a sampling chamber of the fluid sampler by operating an actuator, obtaining a fluid sample in the sampling chamber of the fluid sampler and pressurizing the fluid sample using a self-contained pressure source of the fluid sampler that is in fluid communication with the sampling chamber.

The method may also include receiving a predetermined input signal with a signal detector, activating a trigger to create a failure of a barrier with a control circuit to enable a fluid to flow from a first chamber to a second chamber in the actuator and shifting a piston from a first position to a second position in the actuator. In addition, the method may include obtaining a first portion of the fluid sample in a debris chamber, displacing a debris trap piston within the sampling chamber to receive a remainder of the fluid sample in the sampling chamber and determining the volume of the fluid sample based upon the position of the magnetic locator associated with the debris trap piston. The method may further include maintaining a differential pressure across a valving assembly disposed within the sampling chamber, actuating the valving assembly by contacting the valving assembly with a piston, piercing through at least a portion of a pressure disk associated with the valving assembly with a piercing assembly associated with the piston, equalizing the pressure across the valving assembly and pressurizing the fluid sample to a pressure greater than a saturation pressure of the fluid sample.

In another aspect, the present invention is directed to a method for obtaining a plurality of fluid samples in a subterranean well. The method includes running a fluid sampler on a wireline conveyance to a target location in the well, establishing a fluid communication path between an exterior of the fluid sampler and a plurality of sampling chambers of the fluid sampler by operating an actuator, obtaining a fluid sample in each of the plurality of sampling chambers of the fluid sampler and pressurizing the fluid samples using a self-contained pressure source of the fluid sampler that is in fluid communication with the sampling chambers.

The method may also include running the fluid sampler on a slickline conveyance to the target location in the well, running the fluid sampler on an electric line conveyance to the target location in the well, simultaneously obtaining the fluid samples in the plurality of sampling chambers, sequentially obtaining the fluid samples in the plurality of sampling chambers and simultaneously pressurizing the fluid samples in the plurality of sampling chambers.

In a further aspect, the present invention is directed to an apparatus for obtaining a plurality of fluid samples in a subterranean well. The apparatus includes a wireline conveyance and a fluid sampler supported by and positioned with the wireline conveyance in the well. The fluid sampler includes an actuator operable to establish a fluid communication path between an exterior and an interior of the fluid sampler, a plurality of sampling chambers operable to receive fluid samples and a self-contained pressure source in fluid communication with the sampling chambers operable to pressurize the fluid samples obtained in the sampling chambers to a pressure above saturation pressure.

In one embodiment, the wireline conveyance may be a slickline. In another embodiment, the wireline conveyance may be an electric line. In certain embodiments, the actuator may includes a signal detector, a control circuit and a trigger, wherein upon receipt of a predetermined input signal by the signal detector, the control circuit activates the trigger to create a failure in a barrier such that fluid flows from a first chamber to a second chamber in the actuator and a piston moves from a first position to a second position in the actuator. In some embodiments, each of the sampling chambers includes a debris trap piston that is operable to receive a first portion of the fluid sample in a debris chamber then displace within the sampling chamber. In these embodiments, a magnetic locator may be operably associated with the debris trap piston to provide a reference to determine the level of displacement of the debris trap piston.

In one embodiment, each of the sampling chambers may includes a valving assembly having a pressure disk that is initially operable to maintain a differential pressure thereacross, wherein the valving assembly is actuated by longitudinally displacing a piston having a piercing assembly relative to the valving assembly such that at least a portion of the piercing assembly travels through the pressure disk, thereby allowing fluid flow therethrough. In other embodiments, the self-contained pressure source may include pressurized nitrogen.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
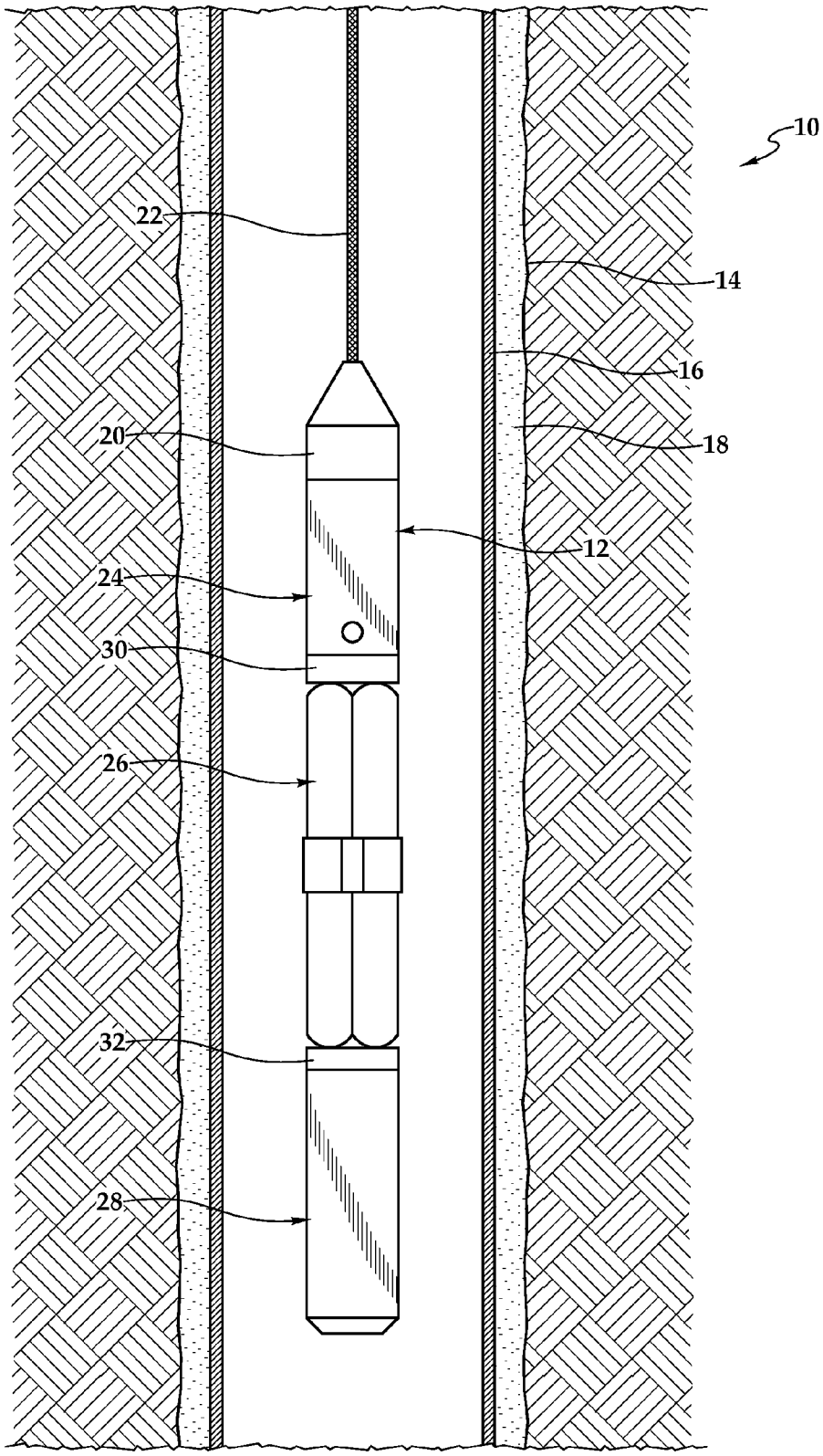
FIG. 1 is a schematic illustration of a fluid sampler system embodying principles of the present invention.

Referring initially to FIG. 1, therein is representatively illustrated a fluid sampler system 10 and associated methods which embody principles of the present invention. A fluid sampler 12 is being run in a wellbore 14 that is depicted as having a casing string 16 secured therein with cement 18. Although wellbore 14 is depicted as being cased and cemented, it could alternatively be uncased or open hole. Fluid sampler 12 includes a cable connector 20 that enables fluid sampler 12 to be coupled to or operably associated with a wireline conveyance 22 that is used to run, retrieve and position fluid sampler 12 in wellbore 14. Wireline conveyance 22 may be a single strand or multistrand wire, cable or braided line, which may be referred to as a slickline or may include one or more electric conductors, which may be referred to as an e-line or electric line. Even though fluid sampler 12 is depicted as being connected directly to cable connector 20, those skilled in the art the understand that fluid sampler 12 could alternatively be coupled within a larger tool string that is being positioned within wellbore 14 via wireline conveyance 22 including a tool string having multiple fluid samplers interconnected therein.

In the illustrated embodiment, fluid sampler 12 includes an actuator assembly 24, a sampler assembly 26 and a self-contained pressure source assembly 28. Preferably, sampler assembly 26 includes multiple sampling chambers, two being visible in FIG. 1. In order to route the fluid samples into the desired sampling chamber, fluid sampler 12 includes a manifold assembly 30 positioned between actuator assembly 24 and sampler assembly 26. Valving or other fluid flow control circuitry within manifold assembly 30 may be used to enable fluid samples to be taken in all of the sampling chambers simultaneously or to allow fluid samples to be sequentially taken into the various sampling chambers. In slickline conveyed embodiments, actuator assembly 24 preferably includes timing circuitry such as a mechanical or electrical clock which is used to determine when the fluid sample or samples will be taken. Alternatively, a pressure signal or other wireless input signal could be used to initiate operation of actuator assembly 24. In electric line conveyed embodiments, actuator assembly 24 preferably includes electrical circuitry operable to communicate with surface systems via the electric line to initiate operation of actuator assembly 24.

After the fluid samples are taken, in order to route pressure into the desired sampling chamber, fluid sampler 12 includes a manifold assembly 32 positioned between sampler assembly 26 and self-contained pressure source 28. Self-contained pressure source 28 may include one or more pressure chambers that initially contain a pressurized fluid, such as a compressed gas or liquid, and preferably contain compressed nitrogen at between about 10,000 psi and 20,000 psi. Those skilled in the art will understand that other fluids or combinations of fluids and/or other pressures both higher and lower could be used, if desired. Depending on the number of sampling chambers and the number of pressure chambers, valving or other fluid flow control circuitry within manifold assembly 32 may be operated such that self-contained pressure source 28 serves as a common pressure source to simultaneously pressurize all sampling chambers or may be operated such that self-contained pressure source 28 independently pressurizes certain sampling chambers sequentially. In the case of multiple sampling chambers and multiple pressure chambers, manifold assembly 32 may be operated such that pressure from certain pressure chambers of self-contained pressure source 28 is routed to certain sampling chambers.

Even though FIG. 1 depicts a vertical well, it should be noted by one skilled in the art that the fluid sampler of the present invention is equally well-suited for use in deviated wells, inclined wells, horizontal wells, multilateral wells and the like. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Figure 2:
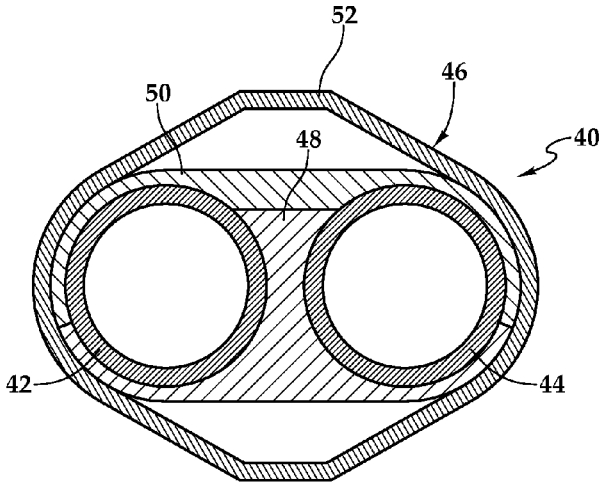
FIG. 2 is a cross-sectional view of an embodiment of a sampler assembly of a fluid sampler embodying principles of the present invention.

Referring now to FIG. 2, therein is depicted a cross-sectional view of one embodiment of a sampler assembly of a fluid sampler embodying principles of the present invention that is generally designated 40. In the illustrated portion, sampler assembly 40 includes two sampling chambers 42, 44. As discussed above, valving or other fluid flow control circuitry within the manifold assembly between sampler assembly 40 and the actuator assembly may be used to enable fluid samples to be taken in sampling chambers 42, 44 simultaneously or sequentially. Likewise, valving or other fluid flow control circuitry within the manifold assembly between the pressure source and sampler assembly 40 may be used to enable simultaneous or independent pressurization of the fluid samples in sampling chambers 42, 44.

Sampler assembly 40 includes a support assembly 46 that may be in the form of a carrier assembly that extends longitudinally along a portion of or substantially the entire length of sampling chambers 42, 44. Alternatively, support assembly 46 may be formed in discontinuous sections that are distributed at intervals along the length of sampling chambers 42, 44. In the illustrated embodiment, support assembly 46 includes a chamber receiving assembly 48, a retainer member 50 that is securably attachable to chamber receiving assembly 48 by mechanical means such as bolting and an outer housing 52. In this configuration, chamber receiving assembly 48, retainer member 50 and outer housing 52 provide longitudinal stability to sampling chambers 42, 44.

Figure 3:
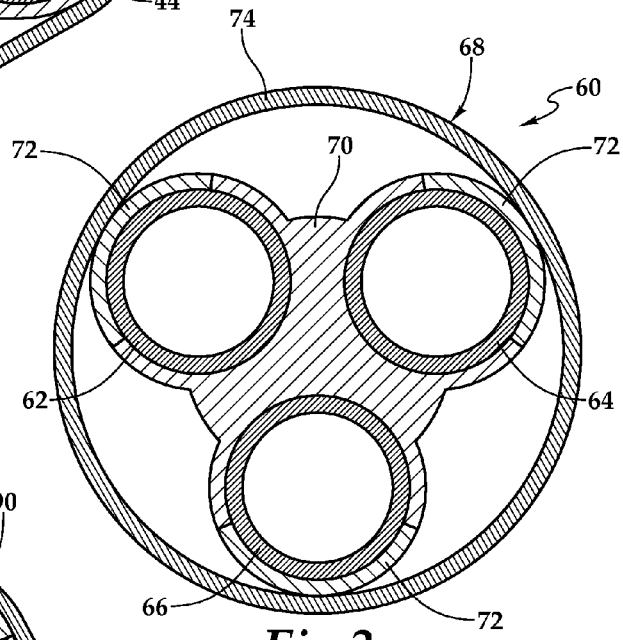
FIG. 3 is a cross-sectional view of an embodiment of a sampler assembly of a fluid sampler embodying principles of the present invention.

Referring now to FIG. 3, therein is depicted a cross-sectional view of one embodiment of a sampler assembly of a fluid sampler embodying principles of the present invention that is generally designated 60. In the illustrated portion, sampler assembly 60 includes three sampling chambers 62, 64, 66. As discussed above, valving or other fluid flow control circuitry within the manifold assembly between sampler assembly 60 and the actuator assembly may be used to enable fluid samples to be taken in sampling chambers 62, 64, 66 simultaneously or sequentially. Likewise, valving or other fluid flow control circuitry within the manifold assembly between the pressure source and sampler assembly 60 may be used to enable simultaneous or independent pressurization of the fluid samples in sampling chambers 62, 64, 66.

Sampler assembly 60 includes a support assembly 68 that may be in the form of a carrier assembly that extends longitudinally along a portion of or substantially the entire length of sampling chambers 62, 64, 66. Alternatively, support assembly 68 may be formed in discontinuous sections that are distributed at intervals along the length of sampling chambers 62, 64, 66. In the illustrated embodiment, support assembly 68 includes a chamber receiving assembly 70, a plurality of retainer members 72 that are securably attachable to chamber receiving assembly 70 by mechanical means such as bolting and an outer housing 74. In this configuration, chamber receiving assembly 70, retainer members 72 and outer housing 74 provide longitudinal stability to sampling chambers 62, 64, 66.

Figure 4:
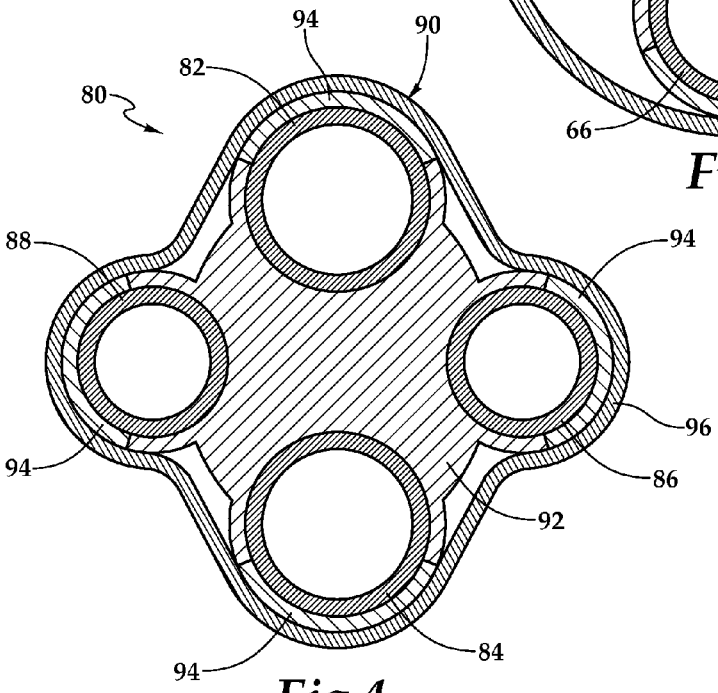
FIG. 4 is a cross-sectional view of an embodiment of a sampler and pressure source assembly of a fluid sampler embodying principles of the present invention.

Referring now to FIG. 4, therein is depicted a cross-sectional view of one embodiment of a sampler and pressure source assembly of a fluid sampler embodying principles of the present invention that is generally designated 80. Unlike fluid samplers 12, 40 and 60 described above wherein the sampler assembly and pressure source assembly are longitudinally separated by a manifold, in fluid sampler 80, the sampler assembly and the pressure source assembly occupy the same longitudinal portion of fluid sampler 80. Specifically, in the illustrated portion, sampler and pressure source assembly 80 includes two sampling chambers 82, 84 and two pressure chambers 86, 88. As discussed above, valving or other fluid flow control circuitry within the manifold assembly between sampler and pressure source assembly 80 and the actuator assembly may be used to enable fluid samples to be taken in sampling chambers 82, 84 simultaneously or sequentially. Likewise, valving or other fluid flow control circuitry within a manifold assembly functionally between sampling chambers 82, 84 and pressure chambers 86, 88 may be used to enable simultaneous or independent pressurization of the fluid samples in sampling chambers 82, 84.

Sampler and pressure source assembly 80 includes a support assembly 90 that may be in the form of a carrier assembly that extends longitudinally along a portion of or substantially the entire length of sampling chambers 82, 84 and pressure chambers 86, 88. Alternatively, support assembly 90 may be formed in discontinuous sections that are distributed at intervals along the length of sampling chambers 82, 84 and pressure chambers 86, 88. In the illustrated embodiment, support assembly 90 includes a chamber receiving assembly 92, a plurality of retainer members 94 that are securably attachable to chamber receiving assembly 92 by mechanical means such as bolting and an outer housing 96. In this configuration, chamber receiving assembly 92, retainer members 94 and outer housing 96 provide longitudinal stability to sampling chambers 82, 84 and pressure chambers 86, 88.

Figure 5A:
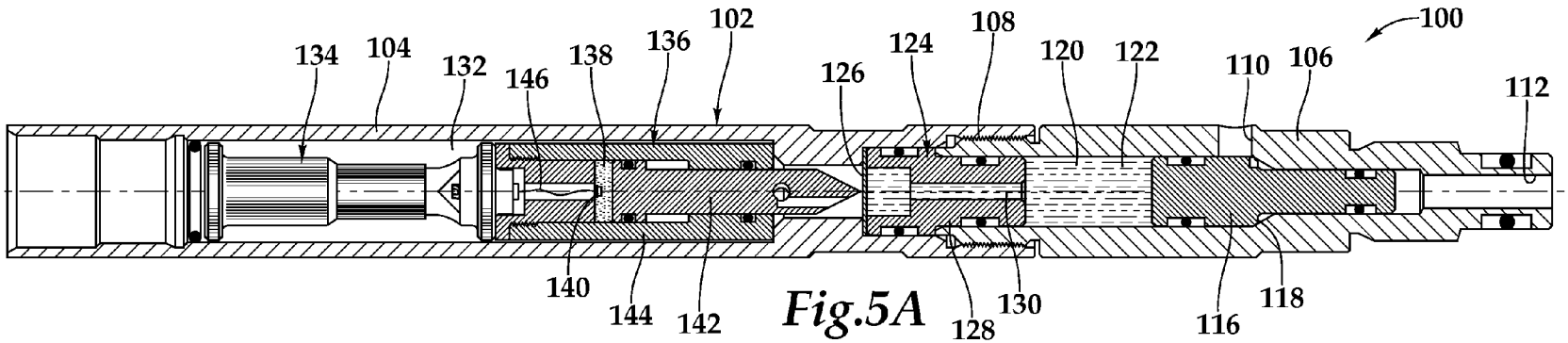
FIG. 5A is a cross-sectional view of an actuator assembly for controlling fluid communication into a fluid sampler embodying principles of the present invention in a run in configuration.
Figure 5B:
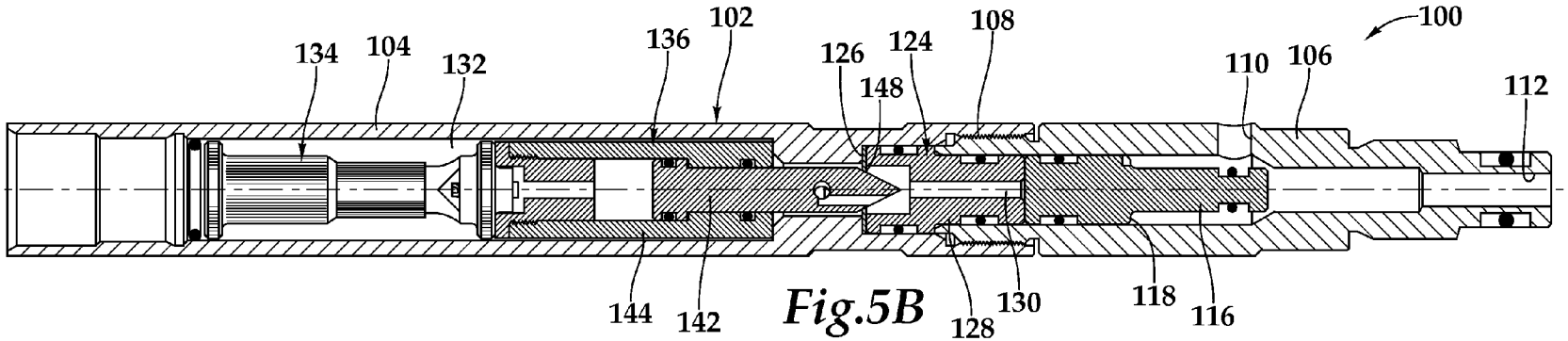
FIG. 5B is a cross-sectional view of an actuator assembly for controlling fluid communication into a fluid sampler embodying principles of the present invention in an actuated configuration.
Figure 6A:
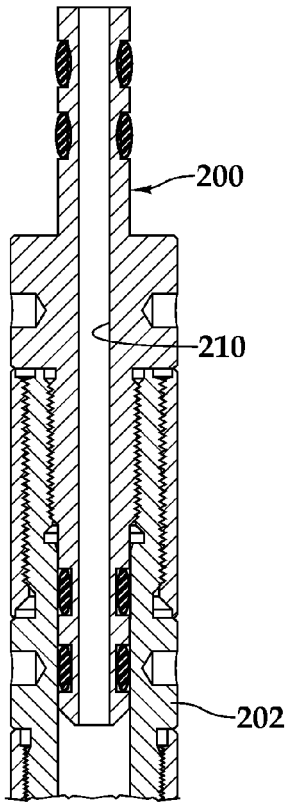
FIGS. 6A-6F are cross-sectional views of successive axial portions of an embodiment of a sampling chamber of a fluid sampler embodying principles of the present invention.
Figure 6B:
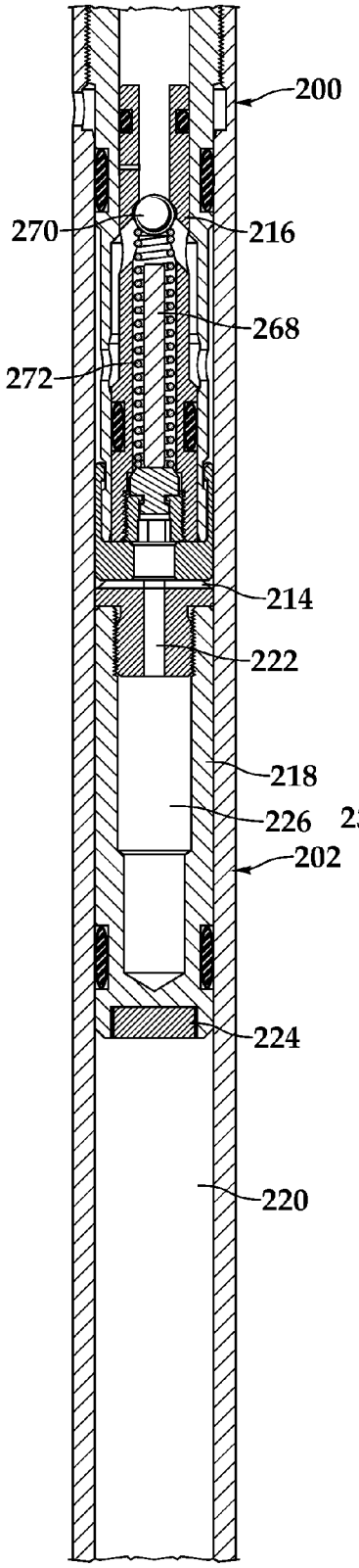
Figure 6C:
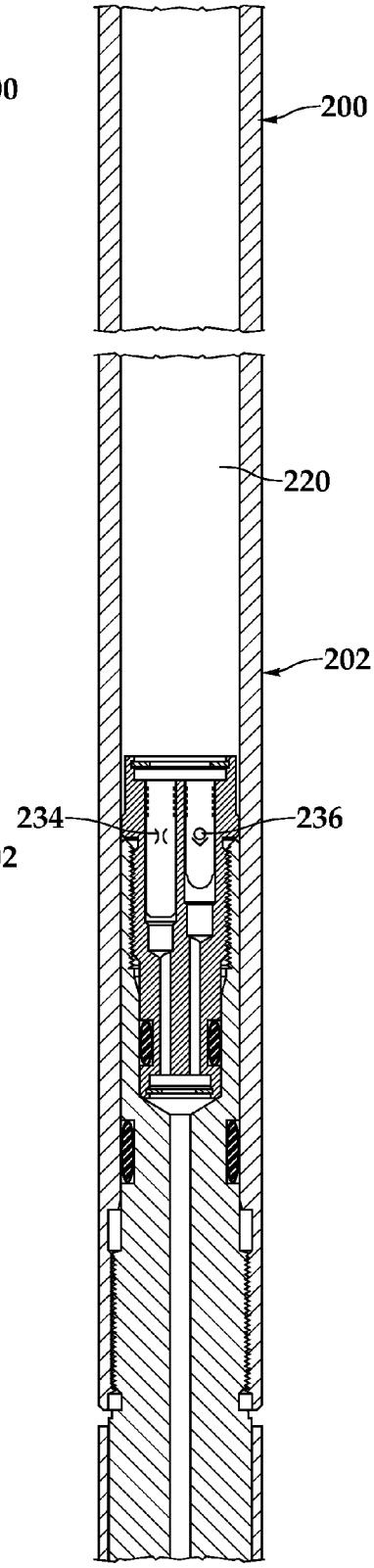
Figure 6D:
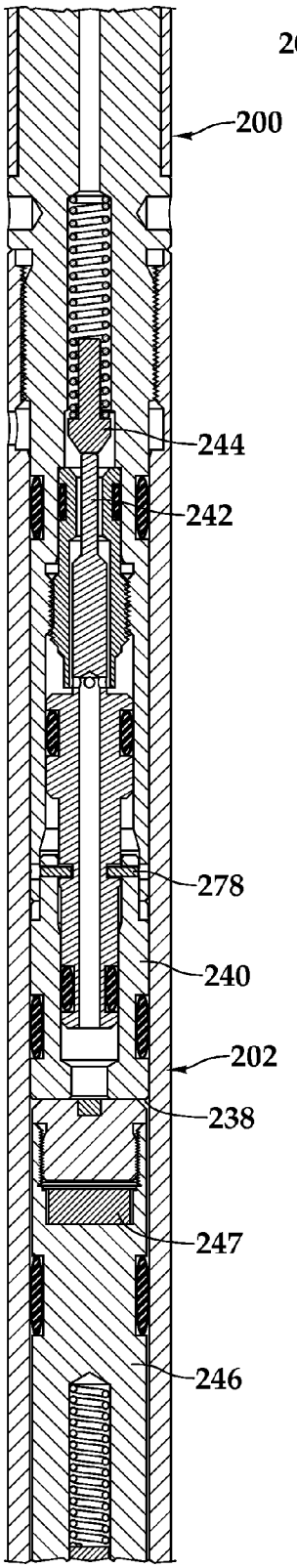
Figure 6E:
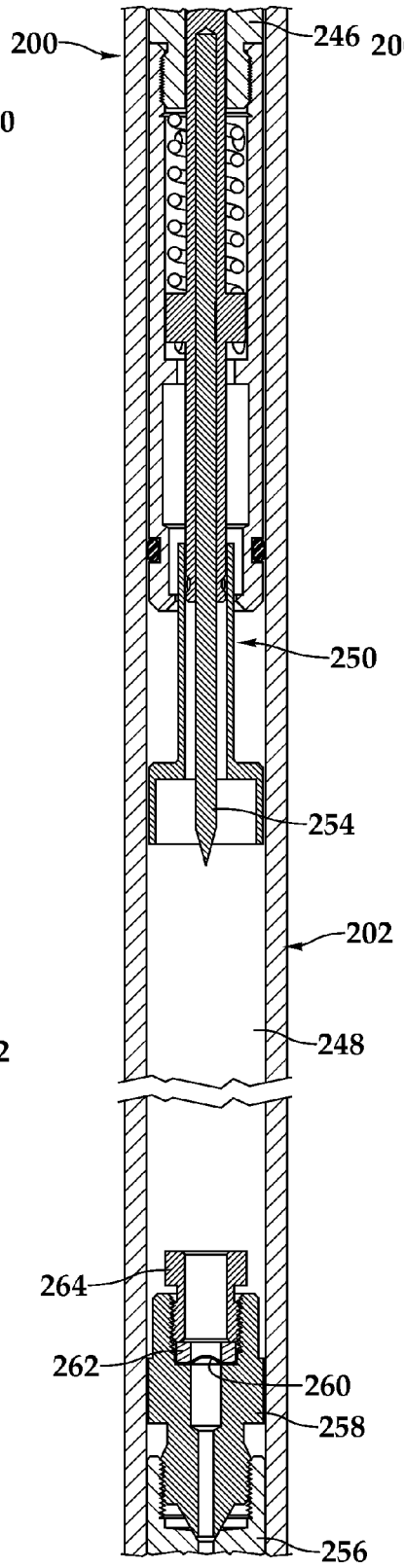
Figure 6F:
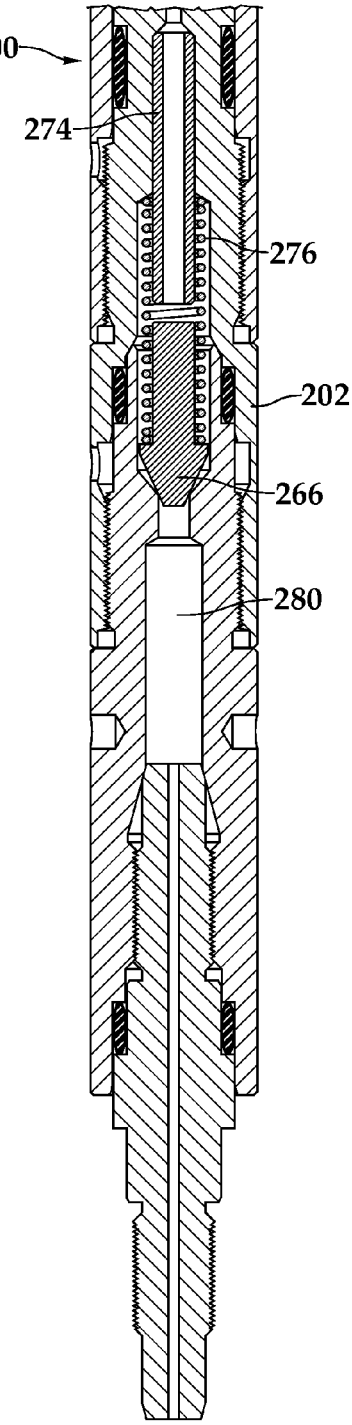

Referring now to FIGS. 5A-5B, an actuator for controlling fluid communication into a fluid sampler is generally designated 100. Actuator 100 may be a part of an actuator assembly of a fluid sampler such as actuator assembly 22 of FIG. 1. Actuator 100 has an axially extending generally tubular body or housing assembly 102 including two housing members 104, 106 that are securably coupled together at a threaded coupling 108. Housing member 106 includes a port 110 that is in fluid communication with the exterior of the fluid sampler and a fluid passageway 112 that is in fluid communication with one or more sampling chambers via the manifold. Slidably and sealingly disposed within housing member 106 is a piston 116 that initially blocks communication between port 110 and fluid passageway 112, as best seen in FIG. 5A. Piston 116 is biased to the left by pressure acting on a differential piston area 118. Initially, displacement of piston 116 to the left is substantially prevented by a fluid 120 disposed within a fluid chamber 122. Preferably, while fluid 120 prevents piston 116 from moving sufficiently to the left to open communication between port 110 and fluid passageway 112, piston 116 is able to float as pressure differences between port 110 and fluid passageway 112 are balanced.

Securably and sealingly positioned between housing member 104 and housing member 106 is a barrier assembly 124 that includes a barrier 126 and a support assembly 128 having a fluid passageway 130 defined therethrough. Barrier 126 initially prevents fluid 120 from escaping from chamber 122 into a chamber 132 of housing member 104. Positioned within housing member 104 is a control system 134 that includes or is operably associated with a signal detector, a control circuit, a power supply, optional timing devices and an output signal generator or trigger depicted in FIG. 5A as a chemically initiated piercing assembly 136. Chemically initiated piercing assembly 136 includes a chemical element or energetic material 138, an ignition agent 140 and a piercing element 142 slidably disposed within a cylinder 144. Chemical element 138 is preferably a combustible element such as a propellant that has the capacity for extremely rapid but controlled combustion that produces a combustion event including the production of a large volume of gas at high temperature and pressure.

In an exemplary embodiment, chemical element 138 may comprises a solid propellant such as nitrocellulose plasticized with nitroglycerin or various phthalates and inorganic salts suspended in a plastic or synthetic rubber and containing a finely divided metal. Chemical element 138 may comprise inorganic oxidizers such as ammonium and potassium nitrates and perchlorates such as potassium perchlorate. It should be appreciated, however, that substances other than propellants may be utilized without departing from the principles of the present invention, including other explosives, pyrotechnics, flammable solids or the like. In the illustrated embodiment, ignition agent 140 is connected to the control circuit via an electrical cable 146 so that, when it is determined that actuator 100 should be operated, the control circuit supplies electrical current to ignition agent 140. In slickline conveyed embodiments, actuator 100 may include one or more batteries to supply electrical energy to control system 134. In electric line conveyed embodiments, electrical energy may be supplied to control system 134 from the surface.

In operation, the signal detector of control system 134 receives the predetermined input signal that is verified by the control circuit. The input signal may be generated by a downhole timer operably associated with control system 134 or sent from the surface via the wireline or via wireless telemetry. If the control circuit determines that actuator 100 should be operated, electrical power is supplied from the power supply to ignition agent 140 to initiate the chemical reaction in chemical element 138. The chemical reaction causes piercing element 142 to move to the right piecing barrier 126, as best seen in FIG. 5B. Fluid communication is thus established between chamber 122 and chamber 132 through opening 148, which allows fluid 120 to exit chamber 122 as piston 116 is urged to the left by pressure from the exterior of the fluid sampler acting on differential piston area 118. Fluid communication is now open between port 110 and fluid passageway 112, as best seen in FIG. 5B. Even though a particular actuator 100 has been depicted and described, those skilled in the art will understand that other types of actuators having other types of signal detectors, control circuits, power supplies, timing devices, output signal generators, triggers, pistons and the like may be used in the present fluid sampler without departing from the principle of the present invention.

Referring now to FIGS. 6A-6F a fluid sampling chamber for use in a fluid sampler that embodies principles of the present invention is representatively illustrated and generally designated 200. Preferably, one or more of sampling chambers 200 are positioned in a sampler assembly 24 that is coupled to an actuator assembly 22 and a self-contained pressure source assembly 26 as described above.

As described more fully below, a passage 210 in an upper portion of sampling chamber 200 (see FIG. 6A) is placed in communication with fluid passageway 112 of the actuator (see FIG. 5B) when the fluid sampling operation is initiated using actuator 100. Passage 210 is in communication with a sample chamber 214 via a check valve 216. Check valve 216 permits fluid to flow from passage 210 into sample chamber 214, but prevents fluid from escaping from sample chamber 214 to passage 210.

A debris trap piston 218 is disposed within housing 202 and separates sample chamber 214 from a meter fluid chamber 220. When a fluid sample is received in sample chamber 214, debris trap piston 218 is displaced downwardly relative to housing 202 to expand sample chamber 214. Prior to such downward displacement of debris trap piston 218, however, fluid flows through sample chamber 214 and passageway 222 of piston 218 into debris chamber 226 of debris trap piston 218. The fluid received in debris chamber 226 is prevented from escaping back into sample chamber 214 due to the relative cross sectional areas of passageway 222 and debris chamber 226 as well as the pressure maintained on debris chamber 226 from sample chamber 214 via passageway 222. An optional check valve (not pictured) may be disposed within passageway 222 if desired. In this manner, the fluid initially received into sample chamber 214 is trapped in debris chamber 226. Debris chamber 226 thus permits this initially received fluid to be isolated from the fluid sample later received in sample chamber 214. Debris trap piston 218 includes a magnetic locator 224 used as a reference to determine the level of displacement of debris trap piston 218 and thus the volume within sample chamber 214 after a sample has been obtained.

Meter fluid chamber 220 initially contains a metering fluid, such as a hydraulic fluid, silicone oil or the like. A flow restrictor 234 and a check valve 236 control flow between chamber 220 and an atmospheric chamber 238 that initially contains a gas at a relatively low pressure such as air at atmospheric pressure. A collapsible piston assembly 240 includes a prong 242 which initially maintains check valve 244 off seat, so that flow in both directions is permitted through check valve 244 between chambers 220, 238. When elevated pressure is applied to chamber 238, however, as described more fully below, piston assembly 240 collapses axially, and prong 242 will no longer maintain check valve 244 off seat, thereby preventing flow from chamber 220 to chamber 238.

A piston 246 disposed within housing 202 separates chamber 238 from a longitudinally extending atmospheric chamber 248 that initially contains a gas at a relatively low pressure such as air at atmospheric pressure. Piston 246 includes a magnetic locator 247 used as a reference to determine the level of displacement of piston 246 and thus the volume within chamber 238 after a sample has been obtained. Piston 246 included a piercing assembly 250 at its lower end. In the illustrated embodiment, piercing assembly 250 is spring mounted within piston 246 and includes a needle 254. Needle 254 has a sharp point at its lower end and may have a smooth outer surface or may have an outer surface that is fluted, channeled, knurled or otherwise irregular. As discussed more fully below, needle 254 is used to actuate the pressure delivery subsystem of the fluid sampler when piston 246 is sufficiently displaced relative to housing 202.

Below atmospheric chamber 248 and disposed within the longitudinal passageway of housing 202 is a valving assembly 256. Valving assembly 256 includes a pressure disk holder 258 that receives a pressure disk therein that is depicted as rupture disk 260, however, other types of pressure disks that provide a seal, such as a metal-to-metal seal, with pressure disk holder 258 could also be used including a pressure membrane or other piercable member. Rupture disk 260 is held within pressure disk holder 258 by hold down ring 262 and gland 264 that is threadably coupled to pressure disk holder 258. Valving assembly 256 also includes a check valve 266. Valving assembly 256 initially prevents communication between chamber 248 and a passage 280 in a lower portion of sampling chamber 200. After actuation the pressure delivery subsystem by needle 254, check valve 266 permits fluid flow from passage 280 to chamber 248, but prevents fluid flow from chamber 248 to passage 280. Preferably, passageway 280 is placed in fluid communication with pressure from the self-contained pressure source via the manifold therebetween.

Once the fluid sampler has been run downhole via the wireline conveyance to the desired location and is in its operable configuration, a fluid sample can be obtained into one or more of the sample chambers 214 by operating actuator 100. Fluid from passage 112 then enters passage 210 in the upper portion of each of the desired sampling chambers 200. For clarity, the operation of only one of the sampling chambers 200 after receipt of a fluid sample therein is described below. The fluid sample flows from passage 210 through check valve 216 to sample chamber 214. It is noted that check valve 216 may include a restrictor pin 268 to prevent excessive travel of ball member 270 and over compression or recoil of spiral wound compression spring 272. An initial volume of the fluid sample is trapped in debris chamber 226 of piston 218 as described above. Downward displacement of piston 218 is slowed by the metering fluid in chamber 220 flowing through restrictor 234. This prevents pressure in the fluid sample received in sample chamber 214 from dropping below its saturation pressure.

As piston 218 displaces downward, the metering fluid in chamber 220 flows through restrictor 234 into chamber 238. At this point, prong 242 maintains check valve 244 off seat. The metering fluid received in chamber 238 causes piston 246 to displace downwardly. Eventually, needle 254 pierces rupture disk 260 which actuates valving assembly 256. Actuation of valving assembly 256 permits pressure from the self-contained pressure source to be applied to chamber 248. Specifically, once rupture disk 260 is pierced, the pressure from the self-contained pressure source passes through passage 280 and valving assembly 256 including moving check valve 266 off seat. In the illustrated embodiment, a restrictor pin 274 prevents excessive travel of check valve 266 and over compression or recoil of spiral wound compression spring 276. Pressurization of chamber 248 also results in pressure being applied to chambers 238, 220 and thus to sample chamber 214.

When the pressure from the self-contained pressure source is applied to chamber 238, pins 278 are sheared allowing piston assembly 240 to collapse such that prong 242 no longer maintains check valve 244 off seat. Check valve 244 then prevents pressure from escaping from chamber 220 and sample chamber 214. Check valve 216 also prevents escape of pressure from sample chamber 214. In this manner, the fluid sample received in sample chamber 214 is pressurized such that the fluid sample may be retrieved to the surface without degradation by maintaining the pressure of the fluid sample above its saturation pressure, thereby obtaining a fluid sample that is representative of the fluids present in the formation.

While this invention has been described with a reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for obtaining a fluid sample in a subterranean well comprising:

running a fluid sampler on a wireline conveyance to a target location in the well;

establishing a fluid communication path between an exterior of the fluid sampler and a sampling chamber of the fluid sampler by operating an actuator including receiving a predetermined input signal with a signal detector activating a trigger to create a failure of a barrier with a control circuit to enable a fluid to flow from a first chamber to a second chamber in the actuator and shifting a piston from a first position to a second position in the actuator;

obtaining a fluid sample in the sampling chamber of the fluid sampler; and pressurizing the fluid sample using a self-contained pressure source of the fluid sampler that is in fluid communication with the sampling chamber.

2. The method as recited in claim 1 wherein running the fluid sampler on the wireline conveyance to the target location in the well further comprises running the fluid sampler on the wireline conveyance selected from the group consisting of a slickline and an electric line.

3. The method as recited in claim 1 wherein obtaining the fluid sample in the sampling chamber of the fluid sampler further comprises obtaining a first portion of the fluid sample in a debris chamber.

4. The method as recited in claim 3 further comprising displacing a debris trap piston within the sampling chamber to receive a remainder of the fluid sample in the sampling chamber.

5. The method as recited in claim 1 wherein obtaining the fluid sample in the sampling chamber of the fluid sampler further comprises displacing a piston having a magnetic locator within the sampling chamber and determining the volume of the fluid sample based upon the position of the magnetic locator.

6. The method as recited in claim 1 wherein pressurizing the fluid sample using the self-contained pressure source of the fluid sampler that is in fluid communication with the sampling chamber further comprises maintaining a differential pressure across a valving assembly disposed within the sampling chamber, actuating the valving assembly by contacting the valving assembly with a piston and equalizing the pressure across the valving assembly.

7. The method as recited in claim 6 wherein actuating the valving assembly by contacting the valving assembly with the piston further comprises piercing through at least a portion of a pressure disk associated with the valving assembly with a piercing assembly associated with the piston.

8. The method as recited in claim 1 wherein pressurizing the fluid sample using the self-contained pressure source of the fluid sampler that is in fluid communication with the sampling chamber further comprises pressurizing the fluid sample to a pressure greater than a saturation pressure of the fluid sample.

9. A method for obtaining a plurality of fluid samples in a subterranean well comprising:

running a fluid sampler on a wireline conveyance to a target location in the well;

establishing a fluid communication path between an exterior of the fluid sampler and a plurality of sampling chambers of the fluid sampler by operating an actuator including receiving a predetermined input signal with a signal detector activating a trigger to create a failure of a barrier with a control circuit to enable a fluid to flow from a first chamber to a second chamber in the actuator and shifting a piston from a first position to a second position in the actuator;

obtaining a fluid sample in each of the plurality of sampling chambers of the fluid sampler; and pressurizing the fluid samples using a self-contained pressure source of the fluid sampler that is in fluid communication with the sampling chambers.

10. The method as recited in claim 9 wherein running the fluid sampler on the wireline conveyance to the target location in the well further comprises running the fluid sampler on the wireline conveyance selected from the group consisting of a slickline and an electric line.

11. The method as recited in claim 9 wherein obtaining a fluid sample in each of the plurality of sampling chambers of the fluid sampler further comprises simultaneously obtaining the fluid samples in the plurality of sampling chambers.

12. The method as recited in claim 9 wherein obtaining a fluid sample in each of the plurality of sampling chambers of the fluid sampler further comprises sequentially obtaining the fluid samples in the plurality of sampling chambers.

13. The method as recited in claim 9 wherein pressurizing the fluid samples using the self-contained pressure source of the fluid sampler that is in fluid communication with the sampling chambers further comprises simultaneously pressurizing the fluid samples in the plurality of sampling chambers.

14. An apparatus for obtaining a plurality of fluid samples in a subterranean well comprising:

a wireline conveyance; and a fluid sampler supported by and positioned with the wireline conveyance in the well, the fluid sampler including an actuator operable to establish a fluid communication path between an exterior and an interior of the fluid sampler, a plurality of sampling chambers operable to receive fluid samples and a self-contained pressure source in fluid communication with the sampling chambers operable to pressurize the fluid samples obtained in the sampling chambers to a pressure above saturation pressure;

wherein, the actuator includes a signal detector, a control circuit and a trigger; and wherein, upon receipt of a predetermined input signal by the signal detector, the control circuit activates the trigger to create a failure in a barrier such that fluid flows from a first chamber to a second chamber in the actuator and a piston moves from a first position to a second position in the actuator.

15. The apparatus as recited in claim 14 wherein the wireline conveyance is selected from the group consisting of a slickline and an electric line.

16. The apparatus as recited in claim 14 wherein each of the sampling chambers further comprises a debris trap piston operable to receive a first portion of the fluid sample in a debris chamber then displace within the sampling chamber.

17. The apparatus as recited in claim 16 further comprising a magnetic locator operably associated with the debris trap piston, the magnetic locator providing a reference to determine the level of displacement of the debris trap piston.

18. The apparatus as recited in claim 14 wherein each of the sampling chambers further comprises a valving assembly including a pressure disk that is initially operable to maintain a differential pressure thereacross, wherein the valving assembly is actuated by longitudinally displacing a piston having a piercing assembly relative to the valving assembly such that at least a portion of the piercing assembly travels through the pressure disk, thereby allowing fluid flow therethrough.

19. The apparatus as recited in claim 14 wherein the self-contained pressure source further comprises pressurized nitrogen.

20. A method for obtaining a fluid sample in a subterranean well comprising:

running a fluid sampler on a wireline conveyance to a target location in the well;

establishing a fluid communication path between an exterior of the fluid sampler and a sampling chamber of the fluid sampler by operating an actuator;

obtaining a fluid sample in the sampling chamber of the fluid sampler including obtaining a first portion of the fluid sample in a debris chamber; and pressurizing the fluid sample using a self-contained pressure source of the fluid sampler that is in fluid communication with the sampling chamber.

21. The method as recited in claim 20 wherein running the fluid sampler on the wireline conveyance to the target location in the well further comprises running the fluid sampler on the wireline conveyance selected from the group consisting of a slickline and an electric line.

22. The method as recited in claim 20 further comprising displacing a debris trap piston within the sampling chamber to receive a remainder of the fluid sample in the sampling chamber.

23. The method as recited in claim 20 wherein pressurizing the fluid sample using the self-contained pressure source of the fluid sampler that is in fluid communication with the sampling chamber further comprises pressurizing the fluid sample to a pressure greater than a saturation pressure of the fluid sample.

24. A method for obtaining a fluid sample in a subterranean well comprising:

running a fluid sampler on a wireline conveyance to a target location in the well;

establishing a fluid communication path between an exterior of the fluid sampler and a sampling chamber of the fluid sampler by operating an actuator;

obtaining a fluid sample in the sampling chamber of the fluid sampler;

displacing a piston having a magnetic locator within the sampling chamber;

pressurizing the fluid sample using a self-contained pressure source of the fluid sampler that is in fluid communication with the sampling chamber; and determining the volume of the fluid sample based upon the position of the magnetic locator.

25. The method as recited in claim 24 wherein running the fluid sampler on the wireline conveyance to the target location in the well further comprises running the fluid sampler on the wireline conveyance selected from the group consisting of a slickline and an electric line.

26. The method as recited in claim 24 wherein pressurizing the fluid sample using the self-contained pressure source of the fluid sampler that is in fluid communication with the sampling chamber further comprises pressurizing the fluid sample to a pressure greater than a saturation pressure of the fluid sample.

27. A method for obtaining a fluid sample in a subterranean well comprising:

running a fluid sampler on a wireline conveyance to a target location in the well;

establishing a fluid communication path between an exterior of the fluid sampler and a sampling chamber of the fluid sampler by operating an actuator;

obtaining a fluid sample in the sampling chamber of the fluid sampler; and pressurizing the fluid sample using a self-contained pressure source of the fluid sampler that is in fluid communication with the sampling chamber by maintaining a differential pressure across a valving assembly disposed within the sampling chamber, actuating the valving assembly by contacting the valving assembly with a piston and equalizing the pressure across the valving assembly.

28. The method as recited in claim 27 wherein running the fluid sampler on the wireline conveyance to the target location in the well further comprises running the fluid sampler on the wireline conveyance selected from the group consisting of a slickline and an electric line.

29. The method as recited in claim 27 wherein actuating the valving assembly by contacting the valving assembly with the piston further comprises piercing through at least a portion of a pressure disk associated with the valving assembly with a piercing assembly associated with the piston.

30. The method as recited in claim 27 wherein pressurizing the fluid sample using the self-contained pressure source of the fluid sampler that is in fluid communication with the sampling chamber further comprises pressurizing the fluid sample to a pressure greater than a saturation pressure of the fluid sample.

31. An apparatus for obtaining a plurality of fluid samples in a subterranean well comprising:

a wireline conveyance; and a fluid sampler supported by and positioned with the wireline conveyance in the well, the fluid sampler including an actuator operable to establish a fluid communication path between an exterior and an interior of the fluid sampler, a plurality of sampling chambers operable to receive fluid samples and a self-contained pressure source in fluid communication with the sampling chambers operable to pressurize the fluid samples obtained in the sampling chambers to a pressure above saturation pressure;

wherein, each of the sampling chambers includes a debris trap piston operable to receive a first portion of the fluid sample in a debris chamber then displace within the sampling chamber.

32. The apparatus as recited in claim 31 wherein the wireline conveyance is selected from the group consisting of a slickline and an electric line.

33. The apparatus as recited in claim 31 further comprising a magnetic locator operably associated with the debris trap piston, the magnetic locator providing a reference to determine the level of displacement of the debris trap piston.

34. The apparatus as recited in claim 31 wherein the self-contained pressure source further comprises pressurized nitrogen.

35. An apparatus for obtaining a plurality of fluid samples in a subterranean well comprising:

a wireline conveyance; and a fluid sampler supported by and positioned with the wireline conveyance in the well, the fluid sampler including an actuator operable to establish a fluid communication path between an exterior and an interior of the fluid sampler, a plurality of sampling chambers operable to receive fluid samples and a self-contained pressure source in fluid communication with the sampling chambers operable to pressurize the fluid samples obtained in the sampling chambers to a pressure above saturation pressure;

wherein, each of the sampling chambers further comprises a valving assembly including a pressure disk that is initially operable to maintain a differential pressure thereacross; and wherein, each of the valving assembly is actuated by longitudinally displacing a piston having a piercing assembly relative to the valving assembly such that at least a portion of the piercing assembly travels through the pressure disk, thereby allowing fluid flow therethrough.

36. The apparatus as recited in claim 35 wherein the wireline conveyance is selected from the group consisting of a slickline and an electric line.

37. The apparatus as recited in claim 35 wherein the self-contained pressure source further comprises pressurized nitrogen.

* * * * *